US008171580B2

(12) United States Patent
Wilson et al.

(10) Patent No.: US 8,171,580 B2
(45) Date of Patent: May 8, 2012

(54) PATIENT TRANSFER SYSTEM FOR USE IN STEREOTACTIC RADIATION THERAPY

(75) Inventors: Roger F. Wilson, Sarasota, FL (US); Willet F. Whitmore, III, Longboat Key, FL (US)

(73) Assignee: Medtec, Inc., Kalona, IA (US)

( * ) Notice: Subject to any disclaimer, the term of this patent is extended or adjusted under 35 U.S.C. 154(b) by 435 days.

(21) Appl. No.: 12/474,360

(22) Filed: May 29, 2009

(65) Prior Publication Data

US 2009/0307839 A1 Dec. 17, 2009

Related U.S. Application Data

(60) Provisional application No. 61/073,201, filed on Jun. 17, 2008.

(51) Int. Cl.

| | |
|---|---|
| ***A47C 21/06*** | (2006.01) |
| ***A61G 1/003*** | (2006.01) |
| *A61G 7/10* | (2006.01) |
| *A61G 5/00* | (2006.01) |
| *A61G 7/053* | (2006.01) |

(52) U.S. Cl. ..... 5/81.1 HS; 5/84.1; 5/81.1 R

(58) Field of Classification Search ..... 5/81.1 R, 5/84.1, 81.1 HS

See application file for complete search history.

(56) References Cited

U.S. PATENT DOCUMENTS

| | | | | |
|---|---|---|---|---|
| 3,981,492 | A * | 9/1976 | Hallmann | 5/601 |
| 6,698,041 | B2 * | 3/2004 | VanSteenburg et al. | 5/81.1 R |
| 2002/0095722 | A1 * | 7/2002 | Korver et al. | 5/81.1 R |
| 2002/0174485 | A1 | 11/2002 | Bartels | |
| 2004/0034932 | A1 | 2/2004 | Zacharopoulos et al. | |

FOREIGN PATENT DOCUMENTS

| | | | |
|---|---|---|---|
| GB | 2135250 | A | 8/1984 |

OTHER PUBLICATIONS

International Search Report for PCT/US2009/046856 dated Oct. 1, 2009.

* cited by examiner

*Primary Examiner* — Jonathan Liu
(74) *Attorney, Agent, or Firm* — Caesar, Rivise, Bernstein, Cohen & Pokotilow, Ltd.

(57) ABSTRACT

A patient transfer system including a patient support panel, a first base member mounted on a first support structure, e.g., a gurney, and a second base member mounted on a second support structure, e.g., a patient treatment table. The patient support panel has a pair of longitudinally extending side rails. Each base member has at least one clamp arranged to engage a rail of the patient support panel to hold it in place thereon. The clamps are releasable to enable the patient support panel to be slid off of one base member and onto the other base member. If the support structures are spaced apart at least one bridging member is provided to bridge the gap therebetween and allow the patient support member to be slid thereacross.

14 Claims, 11 Drawing Sheets

PATIENT TRANSFER SYSTEM FOR USE IN STEREOTACTIC RADIATION THERAPY

CROSS-REFERENCE TO RELATED APPLICATIONS

This application claims priority from Provisional Application Ser. No. 61/073,201, filed on Jun. 17, 2008, entitled Patient Transfer System For Use In Stereotactic Radiation Therapy, which application is assigned to the same assignee as this application and whose disclosure is incorporated by reference herein.

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISK

"Not Applicable"

FIELD OF THE INVENTION

This invention relates generally to holding devices and more particularly for devices for transferring patients from a gurney or other movable support structure to a radiation treatment couch or other patient support structure.

BACKGROUND OF THE INVENTION

Patients undergoing radiation therapy for cancer treatment or some other procedure have to be transferred from a gurney on which they have been placed to transport them to the room in which a linear accelerator (LINAC) or other radiation therapy apparatus is located and then onto the treatment couch or table of that apparatus. One common practice to achieve that end is to roll the patient slightly on his/her side on the gurney to provide a space between the sheet on which the patient is disposed and the top pad of the gurney. An elongated patient transfer board formed of a strong low friction material, such as polyethylene, and which is at least as long and wide as the patient is then inserted between the gurney and the sheet on which the patient is disposed. The patient with his/her sheet is then rolled back down onto the board. The board with the patient and the underlying sheet on it is then lifted and/or slid to a position wherein the transfer board bridges the space between the gurney and the treatment couch. Once that has been accomplished the sheet with the patient on it is lifted up and slid from the board to a position fully on the treatment couch.

While the foregoing technique is generally suitable for its intended purpose, it involves "brute force" to overcome friction between the various sheets/coverings of the gurney and treatment couch/table. In particular, when the transfer board has been located in the position bridging the space between the gurney and the treatment couch it leaves a considerable portion of the sheet on the treatment couch exposed and a considerable portion of the sheet or covering of the gurney's pad exposed. Thus, there is considerable friction when sliding the patient and his/her sheet onto the bridging board and then off of the bridging board and fully onto the treatment couch. In a similar manner, there is considerable friction that has to be overcome when using the bridging board to transfer the patient back from the treatment couch to the gurney when the patient's treatment has been completed.

There are some roller systems which are designed to effect the transfer of the patient from the gurney to the treatment table and vice versa, but those systems are somewhat complex and still leave much to be desired.

With the forgoing in mind it should be clear to those skilled in the art that a system and technique for effectively and efficiently transferring the patient from a gurney or other movable table onto a stationary treatment couch or table and vice versa, with ease, with minimum personnel and with minimal disturbance of the patient is desirable. The subject invention addresses that need.

All references cited and/or identified herein are specifically incorporated by reference herein.

SUMMARY OF THE INVENTION

In accordance with one aspect of the invention there is provided a system for transferring a patient from a first support structure, e.g., a movable gurney, to a second support structure, e.g., a treatment table of a radiation therapy machine. The system basically comprises a patient support panel, a first base member and a second base member. The patient support panel itself comprises a pair of longitudinally extending side rail portions. The first base member comprises at least one clamp and is arranged to be mounted on the first support structure. The second base member also comprises at least one clamp and is arranged to be mounted on the second support structure.

The patient support panel is arranged to be disposed on the first support structure. The first support structure is arranged to be moved to an operative position adjacent the second support structure. The first and second base members each have a respective planar surface over which the patient support panel can be readily slid when the first support structure is in the operative position with respect to the second support structure.

The at least one clamp of the first base member is arranged to releasably secure the patient support panel on the first base member via the at least one clamp of the first base member engaging one of the longitudinal extending side rail portions of the patient support panel. In a similar manner the at least one clamp of the second base member is arranged to releasably secure the patient support panel on the second base member via the at least one clamp of the second base member engaging the other of the longitudinal extending side rail portions of the patient support panel.

In accordance with another aspect of this invention the system additionally comprises at least one bridging member and wherein the first base member comprises at least one first recess therein and the second base member comprises at least one second recess therein. The at least one bridging member is arranged to be located within the at least one first and second recess to bridge any space between the first and second support structures so that the patient support panel can be readily slid from the first base member to the second base member and vice versa via the at least one bridging member.

In accordance with another preferred aspect of this invention each of the support structures and the patient support panel has a longitudinal axis. The system includes a lever device arranged to cooperate with either of the base members to effect the orientation of the patient support panel so that the longitudinal axis of the patient support panel is generally aligned with the longitudinal axis of the support structure on which the patient support panel is disposed so that the clamp of the base member can releasably engage a portion of a side rail of the patient support panel.

DETAILED DESCRIPTION OF THE PREFERRED EMBODIMENT

Figure 1:
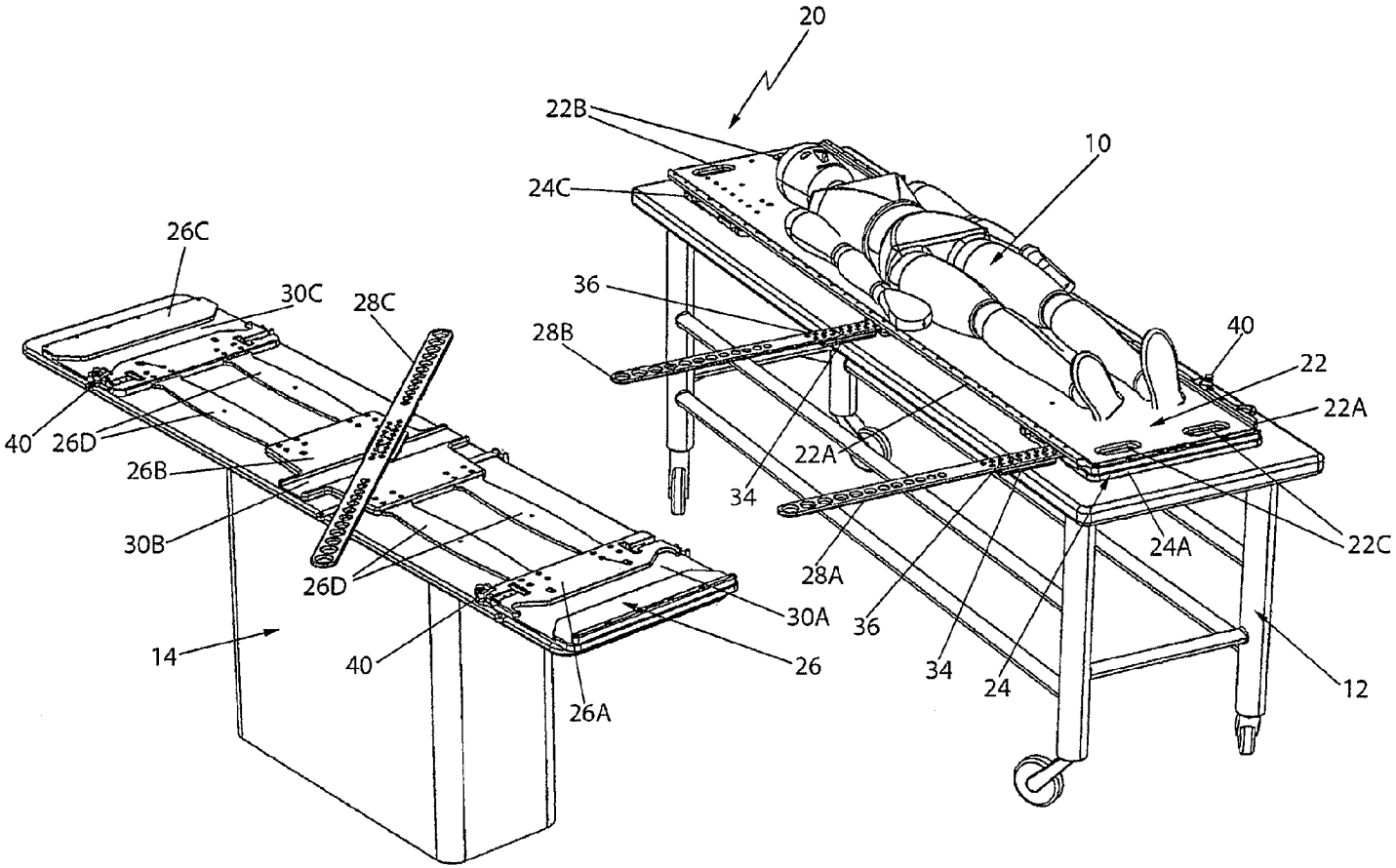
FIG. 1 is an isometric view of one exemplary patient transfer system constructed in accordance with this invention and shown ready for use in transferring a patient from a movable gurney onto a stationary treatment table or couch.

Referring now to the various figures of the drawing wherein like reference characters refer to like parts, there is shown in FIG. 1 a patient transfer system 20 and method of use that provides an effective and simple means to smoothly and with minimal jostling transfer a patient, such as patient 10 shown in FIG. 1, positioned on a conventional gurney 12 to treatment couch (e.g., a scanning or LINAC table) 14 and back again without lifting. The patient transfer system 20 will be described in detail later. Suffice it for now to state that it includes a patient support panel 22 and a pair of modular transfer members or base units 24 and 26 which cooperate with the patient support panel to accurately and repeatably register the patient 10 longitudinally and transversely utilizing existing couch tops (treatment tables) and the universal two pin registration system commonly used today for mounting various components to the couch top.

As shown in FIG. 1 the patient 10 is disposed on the patient support panel 22. The patient support panel 22 not only constitutes a portion of this invention, but of another invention of ours which is disclosed in a U.S. Provisional Patent application filed contemporaneously herewith entitled Stereotactic Radiotherapy System, which is assigned to the same assignee as this invention and whose disclosure is incorporated by reference herein.

The details of the patient support panel 22 will be described in detail later. Suffice it for now to state that the patient support panel is a generally planar member which is of sufficient size to support an adult patient in a prone position like shown in FIG. 1. The patient support panel 22 is arranged to have various components (not shown) for use with the radiation therapy releasably mounted on it via its side rails. Examples of such components are positioning masks, positioning cushions, fiducial marker frames, etc. The patient support panel 22 is arranged to be secured in place, via releasable rail clamps (to be described later) on the base unit portion 24 of the patient transfer system 20 that is located on the gurney 12. The gurney can then be moved to a position beside the treatment couch 14, whereupon the clamps can be released and the patient support panel 22 with the patient 10 thereon slid onto the base portion 26 of the patient transfer system that is located on the treatment couch/table 14. The portion 26 of the patient transfer system also includes releasable clamps to releasably secure the patient support panel 22 with the patient 10 thereon to the top of the treatment couch/table so that the radiation procedure can be effected. Once that has been accomplished the patient can be transferred back to the gurney in a similar manner to the transfer of the patient to the treatment table.

Figure 3:
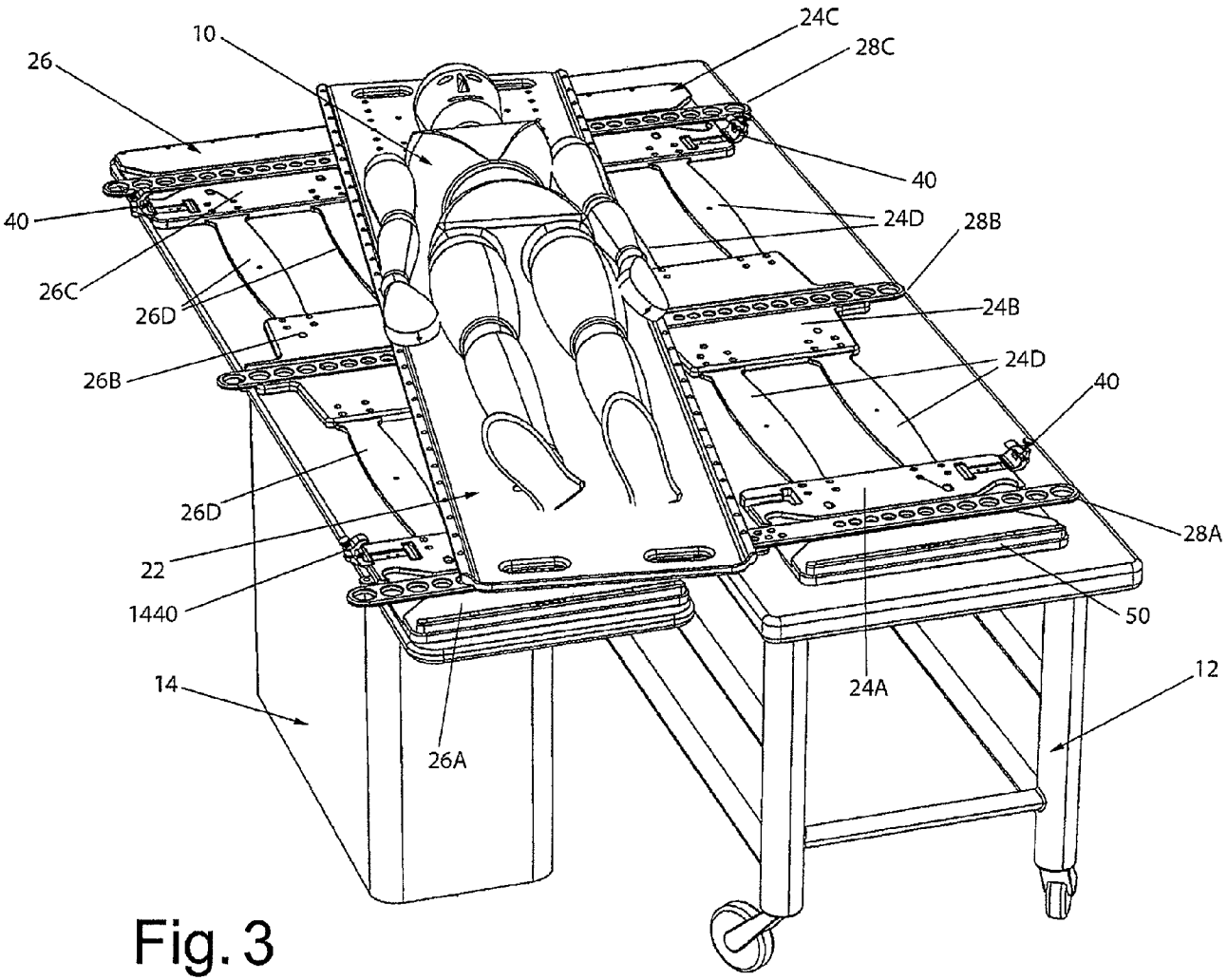
FIG. 3 is an isometric view showing a subsequent step in the transfer of the patient from the gurney to the treatment table.
Figure 4:
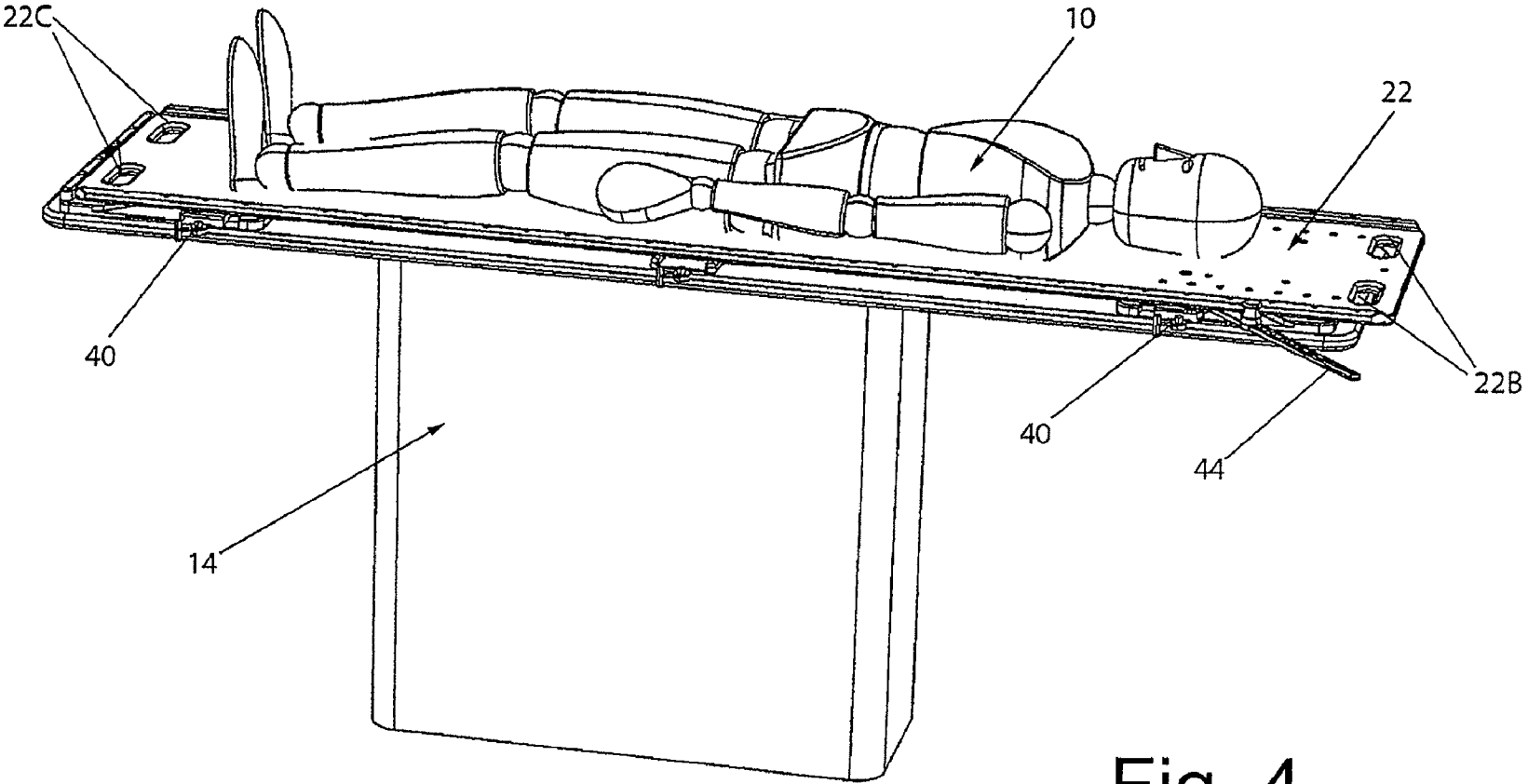
FIG. 4 is an isometric view showing the completed transfer of the patient from the gurney to the treatment table.
Figure 5:
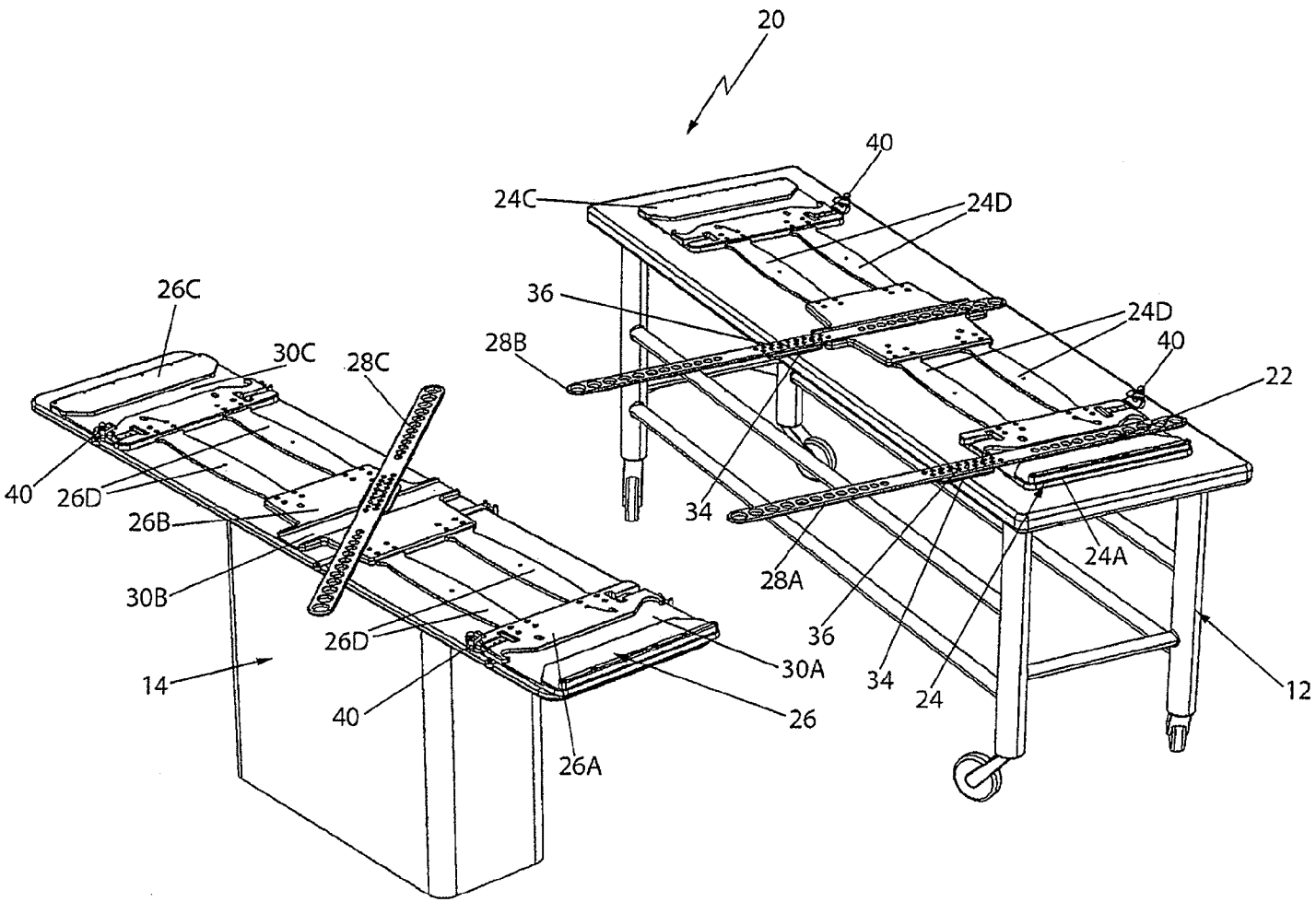
FIG. 5 is an isometric view, similar to FIG. 1, showing the system of FIG. 1, but without the patient support panel on which the patient is located.
Figure 6:
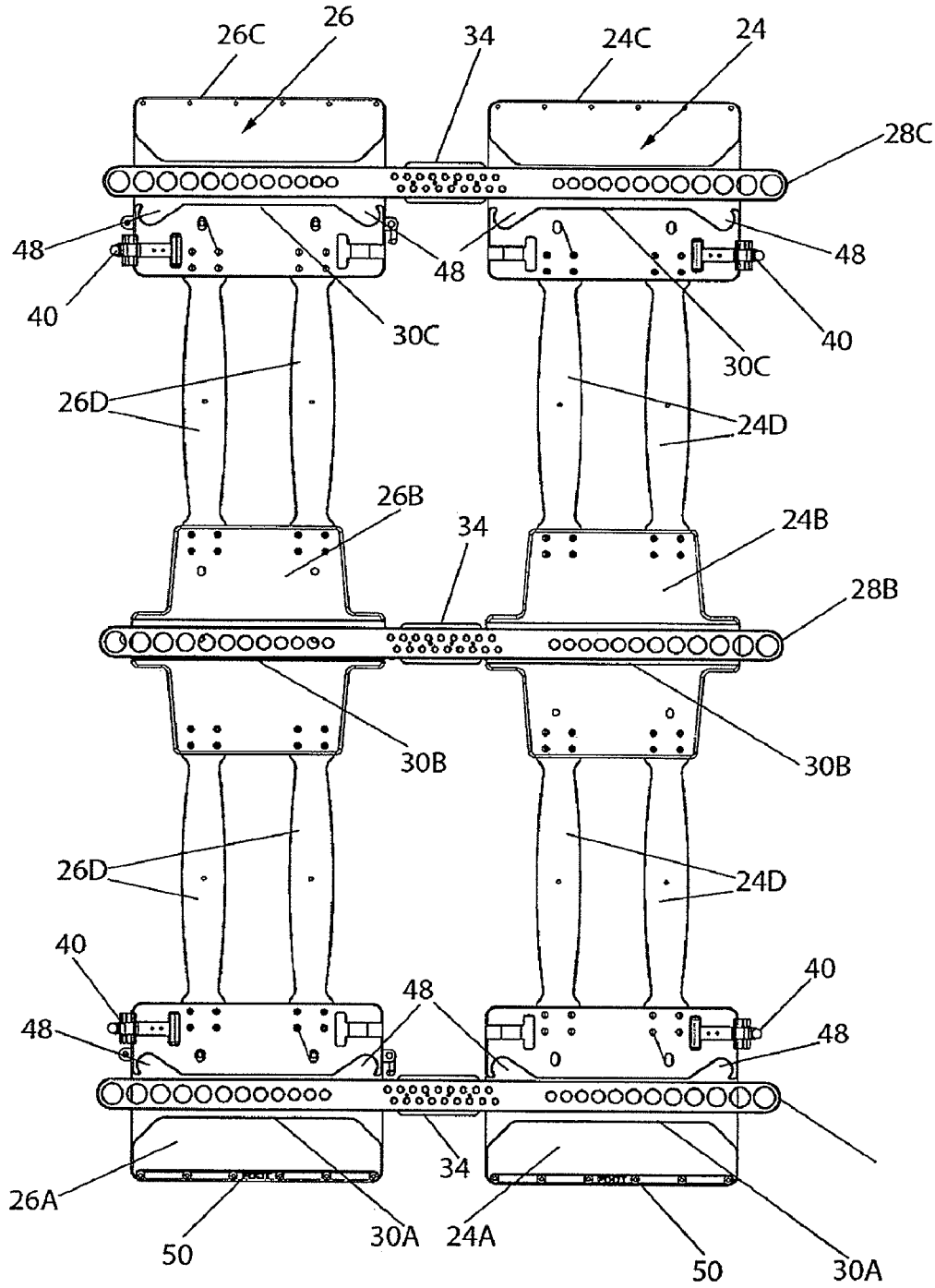
FIG. 6 is a top plan view of the system shown in FIG. 5.
Figure 7:
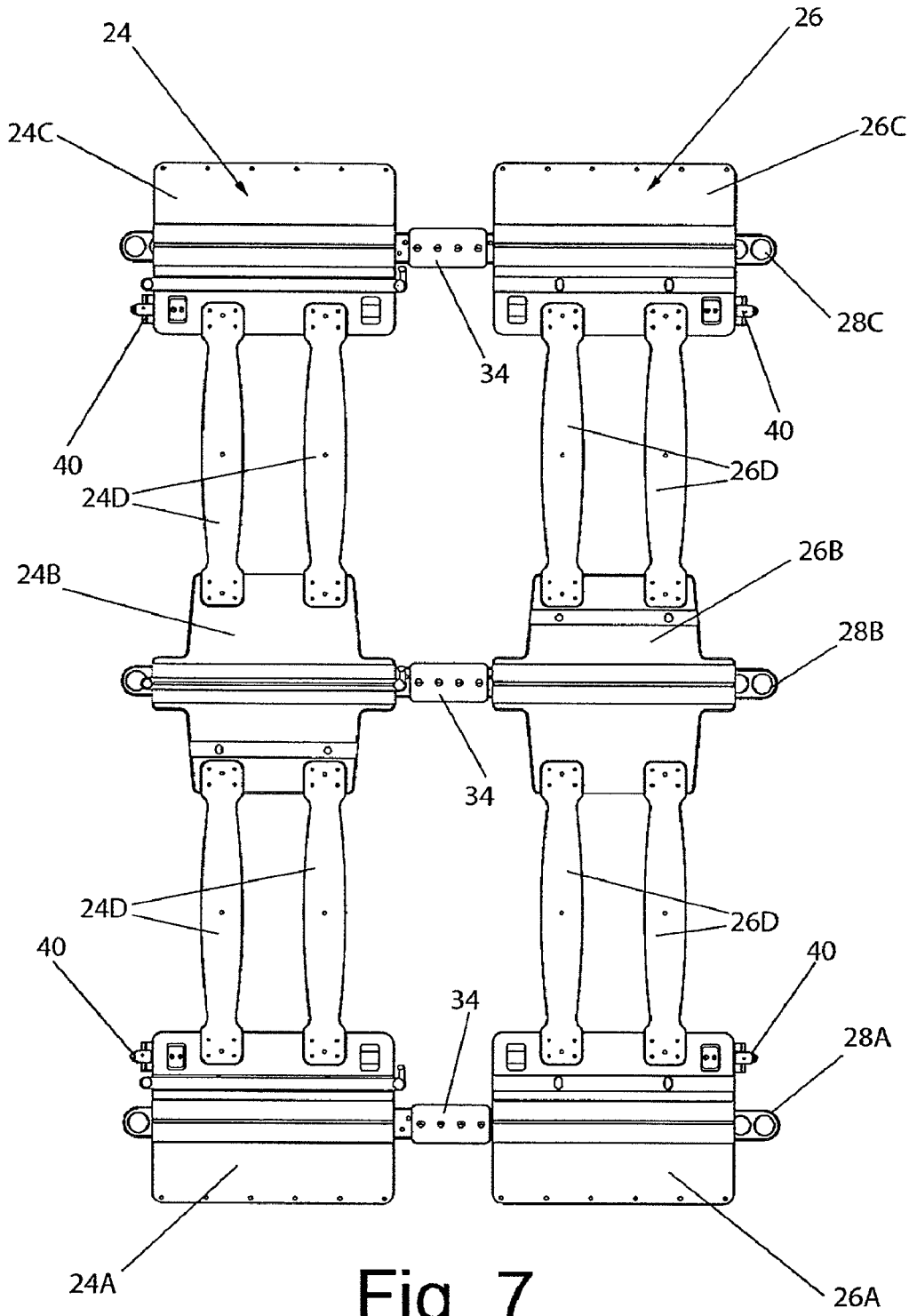
FIG. 7 is a bottom plan view of the system shown in FIG. 5.
Figure 8:
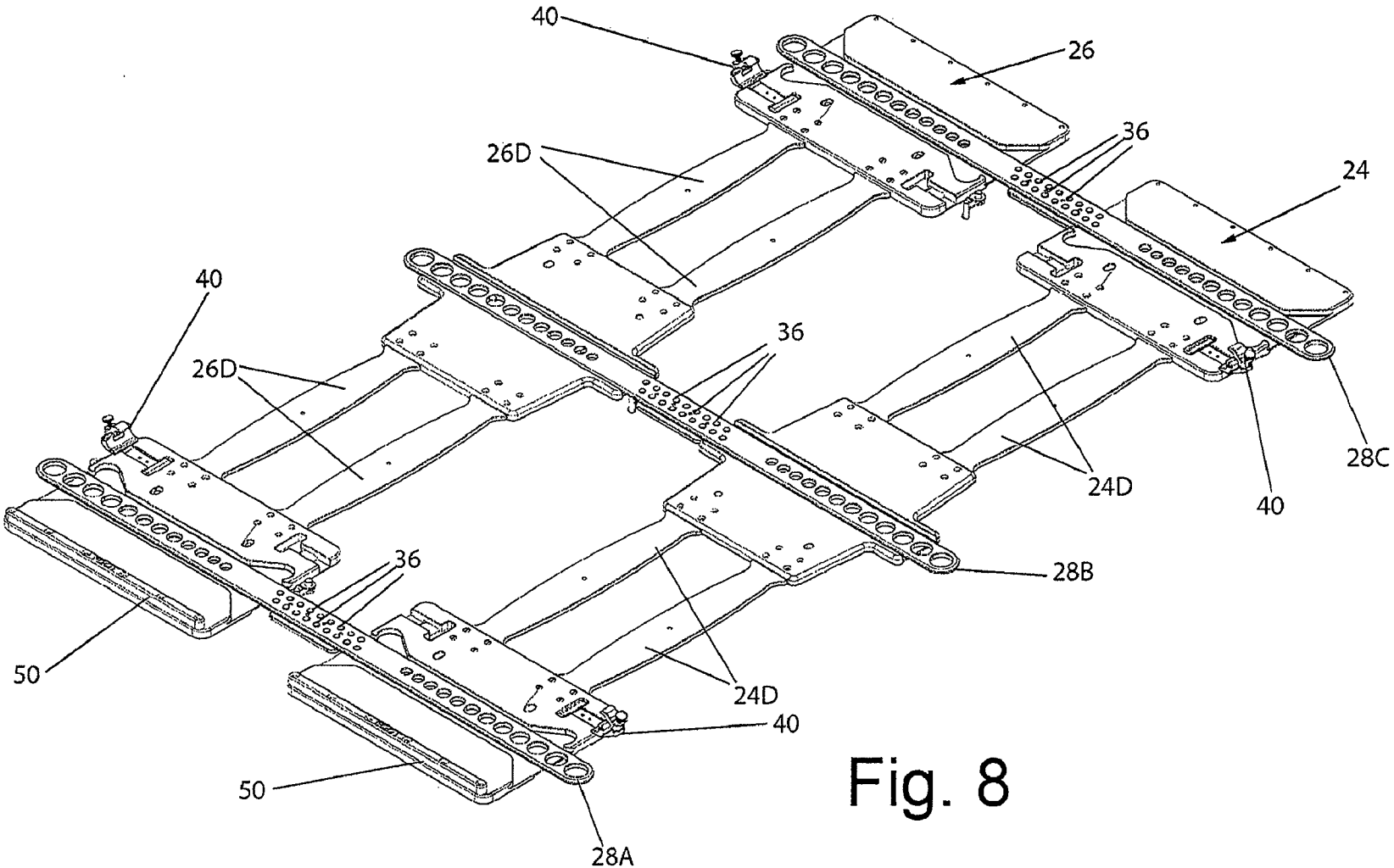
FIG. 8 is a somewhat enlarged isometric view showing the system without the patient support panel.

As best seen in FIGS. 3, 6 and 7 the two modular base members 24 and 26 are identical in construction. In particular, the module 24, which shall be referred to hereinafter as the gurney base module, in the exemplary embodiment shown basically comprises three transfer plates 24A, 24B and 24C that are disposed on the top surface of the gurney. The transfer plates are connected to one another by two pairs of planar legs 24D. If desired the gurney base module can be secured in place by any suitable means.

The base module 26, which shall be referred to hereinafter as the treatment couch module, is mounted on the top of the treatment couch/table 14 of the LINAC or other radiation therapy device (not shown) via a conventional two pin registration system (or any other suitable means). As is known such registration systems make use of elongated bars each having two upwardly projecting pins arranged to be received within correspondingly shaped and located apertures in the bottom surface of a device to be mounted on the treatment table or couch. Each bar of the registration system includes means, e.g., a respective ball, located on a respective end of the bar for securing the bar at various locations along the length of the treatment couch via respective sockets provided along the sides of the couch. The balls and sockets may be reversed, i.e., the bars may include the sockets and the couch top may include the cooperating balls. Alternatively, the two pin registration bar may include clamping members at it respective ends in lieu of balls or sockets to secure it in its desired position on the treatment table.

The treatment couch module 26 includes three base panels (also called transfer plates) 26A, 26B and 26C, each of which is mounted onto the top of the treatment couch 14 by a respective two pin registration bar (not shown). The transfer plates 26A, 26B and 26C are connected to one another by two pairs of planar legs 26D.

Figure 2:
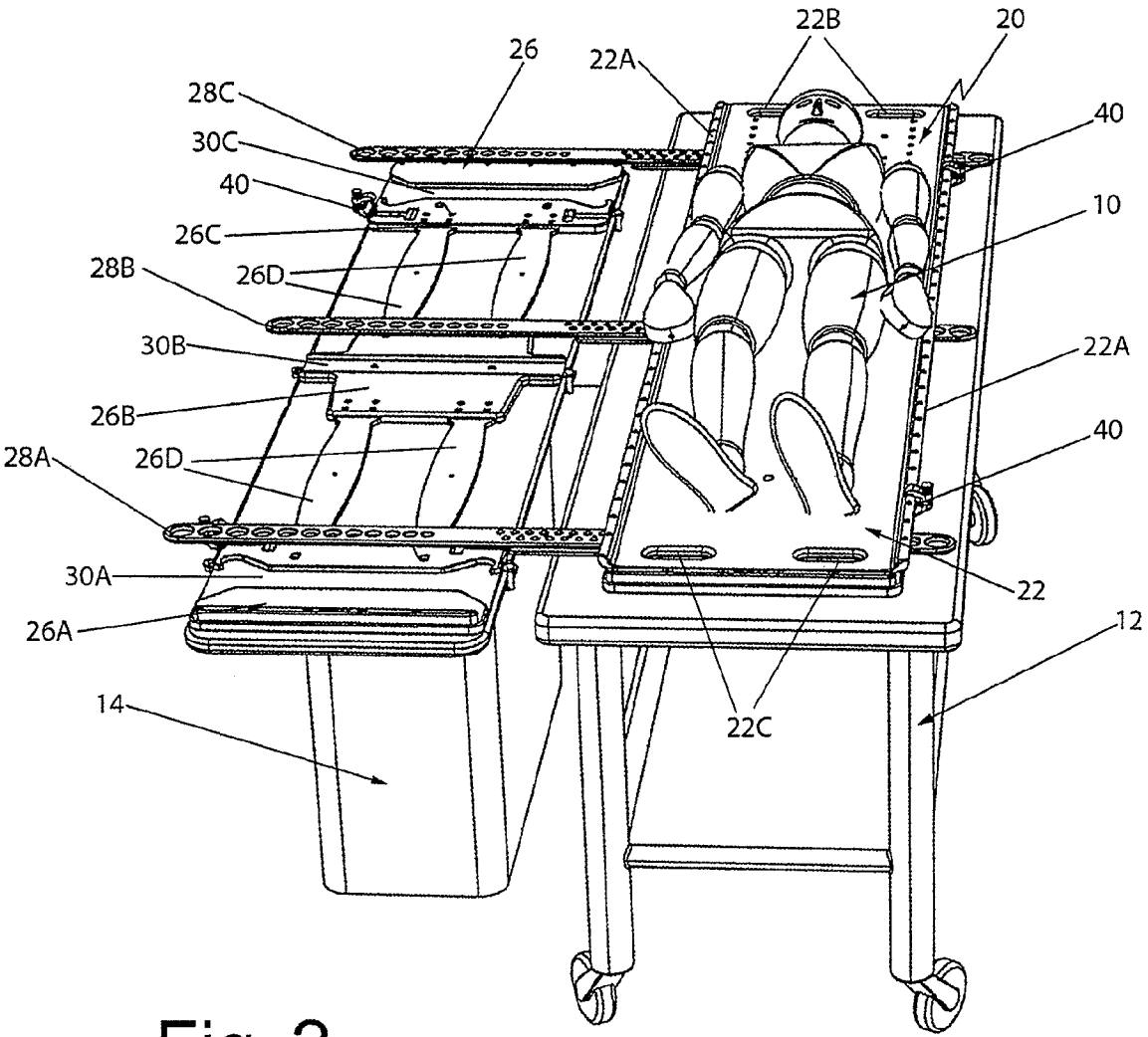
FIG. 2 is an isometric view showing an initial step in the transfer of the patient from the gurney to the treatment table.

Each of the transfer plates of each of the base modules 24 and 26 is a generally planar member having a smooth top surface across which the patient support panel can be readily slid to effect the transfer of the patient support panel from the gurney to the treatment couch and vice versa. For those patient transfer applications wherein the gurney 12 can be brought into lateral abutment with the treatment couch 14, i.e., be brought into side-by-side abutment with it, the patient support panel 22 with the patient 10 thereon can be readily slid from the gurney module 24 directly onto the treatment couch module 26 and vice versa. If however, the gurney cannot be brought into such close lateral proximity to the treatment couch, a plurality of slide members forming an optional portion of the patient transfer system 20 can be employed to bridge the gap between the gurney and the treatment couch. In the exemplary embodiment shown, wherein each module includes three transfer plates, if the gurney 14 has to be located at some distance laterally of the treatment table, such as shown in FIG. 2, three bridging slide members 28A, 28B and 28C are utilized to bridge the gap between the gurney and the treatment couch.

The slide members 28A, 28B and 28C are arranged to be disposed in respective channels or slots 30A, 30B and 30C (to be described later) in the three transfer plates 24A, 24B, and 24C, respectively, making up the gurney module 24. In the exemplary embodiment shown in FIG. 1 only two transfer bars 28A and 28B are shown in place in the plates 24A and 24B. The third bar 28C is shown located in space over one of the transfer plates making up the treatment couch module 26 to illustratively represent that the bars 28A, 28B and 28C are identical separate members that are each arranged to be located (placed) in a respective slot in a respective plate of a respective module of the system.

Figure 13:
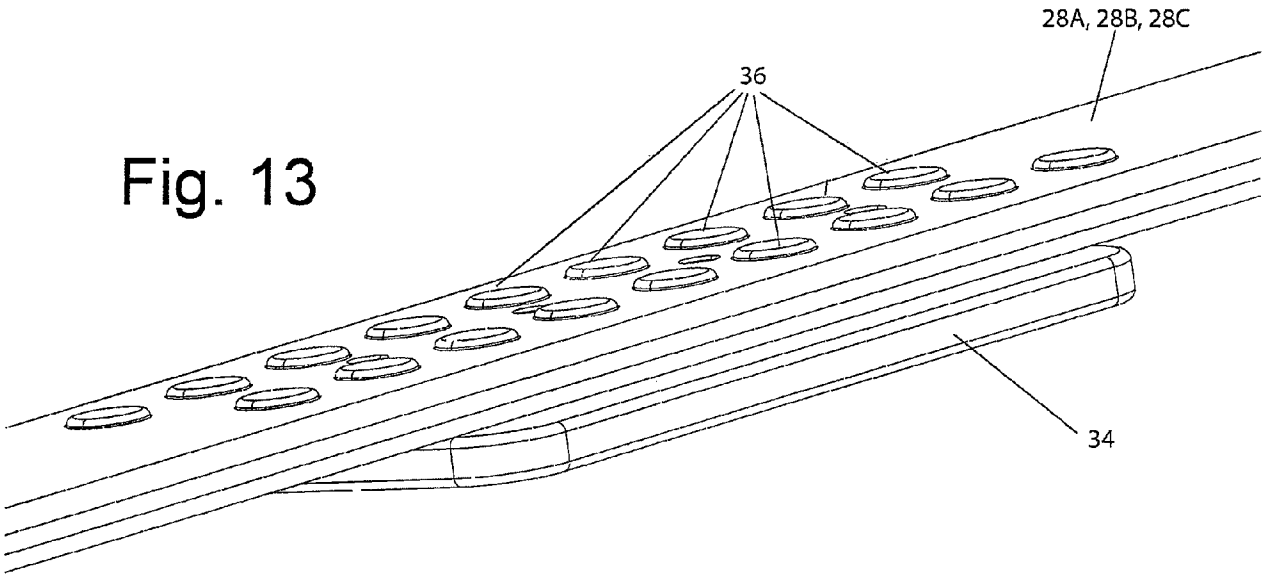
FIG. 13 is an enlarged isometric view of a portion of one of the transfer bars or slides of the system shown in FIG. 1.
Figure 14:
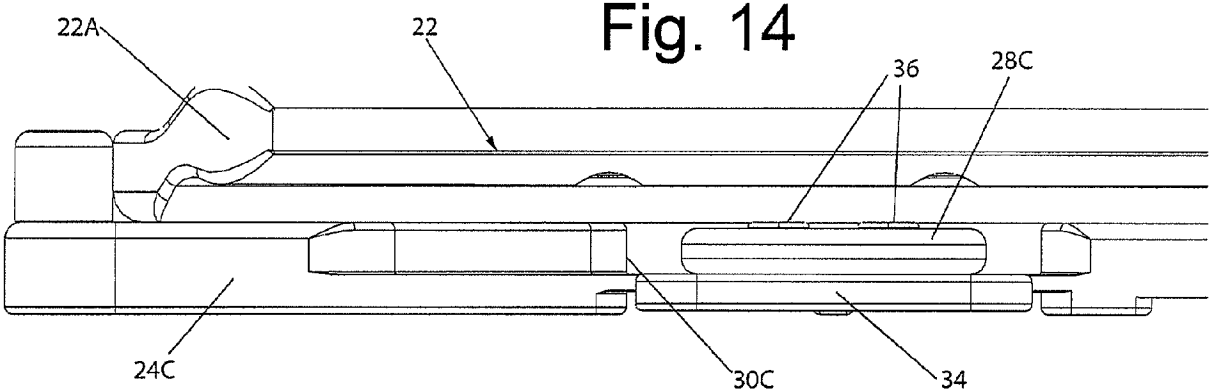
FIG. 14 is an enlarged end view of a portion of the system shown in FIG. 1.

Thus, each slide member 28A, 28B and 28C is an elongated planar bar formed of any strong, yet light weight material, e.g., aluminum. A stop plate 34 is mounted on the underside of each slide bar at the midpoint thereof. The purpose of the stop plate 34 will be described later. In order to facilitate the sliding of the patient support panel across the slide members, each of the slide members includes means forming a low friction slide surface. To that end, as best seen in FIGS. 13 and 14 a plurality of glide buttons 36 are located at the mid-portion of each slide bar. Each glide button 36 includes a head portion which extends upward from the top surface of the slide bar by a short distance (height), e.g., 50 thousandth's of an inch, to serve as a low friction slide surface across which the patient support panel 22 can be freely slid. Each button is formed of a low friction material, e.g., Teflon®.

To transfer a patient on a patient support panel 22 located on a gurney that can't be brought into abutment with a treatment couch, the three slide bars 28A, 28B and 28C are inserted into respective slots 30A, 30B and 30C of the transfer plates 24A, 24B and 24C, respectively, after the patient support panel with the patient thereon has been disposed on the gurney's transfer plates. The thickness (depth) of each of the slots 30A, 30B and 30C is approximately equal to the combined thickness of the slide bar and the head portion of the buttons mounted thereon so that when a slide bar is located within its associated slot of the associated transfer plate the top surface of that transfer plate will be flush or coplanar with the top or glide surface of the buttons. The proximal end of each of slide bars is located within a respective slot in the transfer plates on the gurney. The gurney can then be moved into position with respect to the treatment couch wherein the distal end of the respective slide bars 28A, 28B and 28C are aligned with the slots 30A, 30B and 30C of the transfer plates 26A, 26B and 26C, respectively, on the treatment couch. The gurney is then lowered slightly (or the treatment platform raised) until the transfer bars 28A, 28B and 28C just touch the bottom of the slots 30A, 30B and 30C, respectively, in the transfer plates 26A, 26B and 26C, respectively. The gurney can then be moved closer to the treatment couch whereupon the distal end of each of the transfer bars enters deeper into the associated slot of the associated transfer plate of the treatment couch module. There is plenty of side play in the fit between the bars and the slots, reducing the demand on precise longitudinal alignment. The vertical alignment of the gurney and treatment couch need not be perfect, but the closer the two are to the same height the better.

The stop plates 34 that are mounted on the undersurface of the midsection of each of the slide bars help to set the separation distance between the gurney and treatment couch and also keeps the transfer bars in place during sliding of the patient support table thereacross.

Once the gurney and treatment couch are at their desired spacing with the transfer bars bridging the gap between them, the rail clamps 40 of the system 20 can be released, thereby freeing the patient support panel from its fixed position on top of the gurney module. Before beginning to move (slide) the patient support panel off of the gurney module and onto the bridging bars and from there to the treatment table module, the clamps 40 of the treatment table module are opened. The clamps forming a portion of the gurney module and the treatment table module are identical in construction and will be described later with respect to FIGS. 10 and 11. Suffice it for now to state that each clamp includes a mouth portion 42 that is arranged to grasp a rail portion 22A of the patient support panel 22. There are two rail portions 22A extending along respective longitudinal sides of the patient support panel. Each rail portion is bulbous in cross section. The patient support panel also includes two pairs of handles 22B and 22C located adjacent the respective ends of the panel.

After the two sets of clamps 40 on the gurney module 24 are open, all that is required is to grasp the patient support panel 22 and slide it off of the gurney module and onto the bridging bars and from there to the treatment table module 26. As mentioned earlier the slightly projecting buttons 36 provide a low friction glide surface across which the patient support panel can be readily slid. Moreover, the materials making up of other components of the system 20 are specifically chosen for their low coefficient of friction, e.g., the transfer plates are formed of ultra-high-molecular-weight polyethylene (UHMW) expanded polyethylene and the patient support panel is formed of carbon fiber with a foam core.

As will be appreciated by those skilled in the art, with the system constructed as just described while it may take a little more force to get the patient support panel 22 moving from its initial position on the gurney module 24, once static friction is broken it slides easily with little force. Thus, once the patient support panel begins to move it is rather easy to position it so that its longitudinal side edge rail 22A is brought into engagement with the rail clamps 40 on the treatment table module 26.

Figure 12:
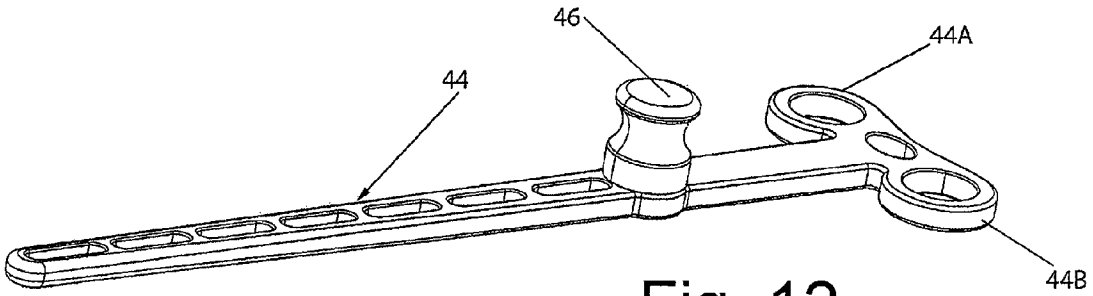
FIG. 12 is an enlarged isometric view of a wrench device that can be used to effect precise alignment of the patient support panel on either the gurney or the treatment couch.
Figure 9:
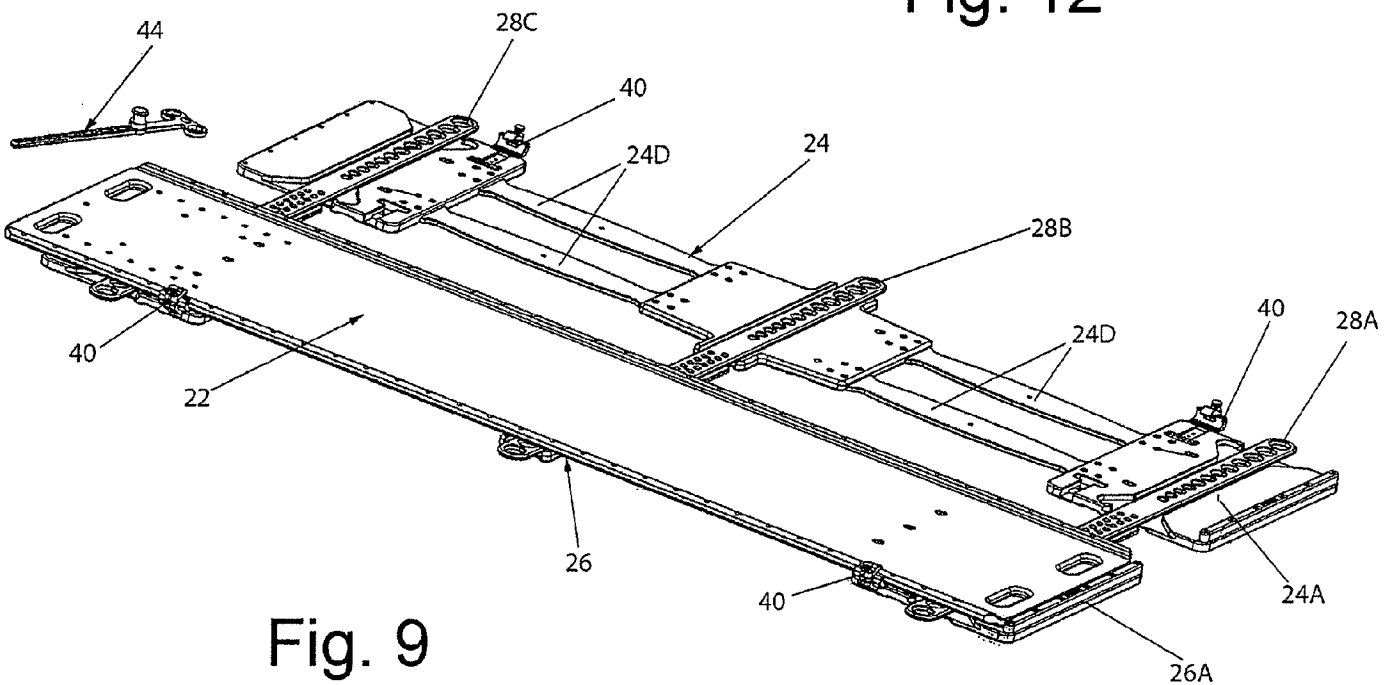
FIG. 9 is a somewhat enlarged isometric view showing the system with the patient support panel and with an orientation adjusting level also forming a part of the system of this invention.

If any fine adjustment of the patient support panel 22 is needed to complete positioning it against the rail clamps 40, a special wrench 44 can be used. The wrench is shown best in FIG. 12 and basically comprises an elongated lever member having one end portion including a pair of rounded projections 44A and 44B and an upstanding boss 46 located adjacent those projections. Each of said transfer plates 24A, 24C, 26A and 26C includes a pair of complementary shaped recesses 48 for receiving one of the projections 44A or 44B of the wrench 44 to enable said wrench to be pivoted in the complementary shaped recess so that its boss 46 gently engages a portion of the peripheral rail 22A of the patient support panel 22 to adjust its orientation and position. Thus, one can insert the special wrench into the recess of the module to gently slide the patient support panel in place against the rail clamps. The positioning of the patient support panel's distal side rail against the rail clamps at the foot and head end ensures that the patient support panel is parallel and repeatedly positioned in relation to the treatment couch. It is also desirable to make sure during final placement of the patient support panel that it is correctly positioned longitudinally (i.e., to achieve longitudinal registration). To that end, each of the end transfer plates 24A and 26A also includes a transversely extending stop 50 against which the foot end of the patient support panel 22 can be brought during the fine adjustment of the orientation of the patient support panel to bring its longitudinally extending distal side rail into engagement with the clamps 40 and its foot end into engagement with the stop 50.

Once the patient support panel and patient are in place on the treatment couch, the gurney is lowered slightly (or the treatment table is raised) to eliminate any possible remaining tension on the transfer bars and they are removed. If desired the gurney can then be moved away from the treatment couch.

Figure 10:
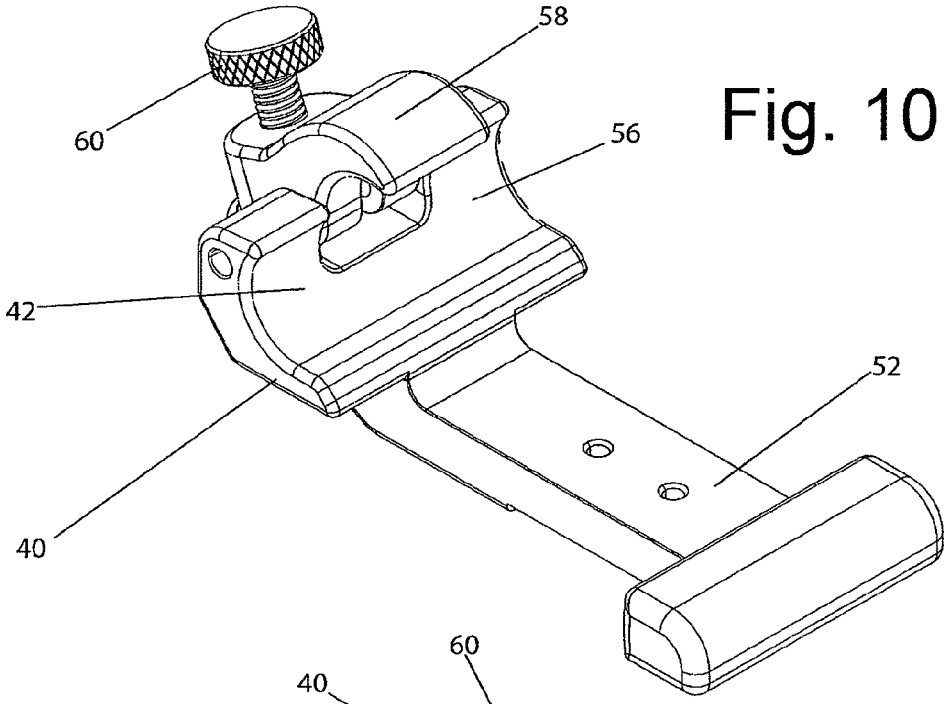
FIG. 10 is an enlarged isometric view of a clamp structure forming a portion of the system shown in FIG. 1.
Figure 11:
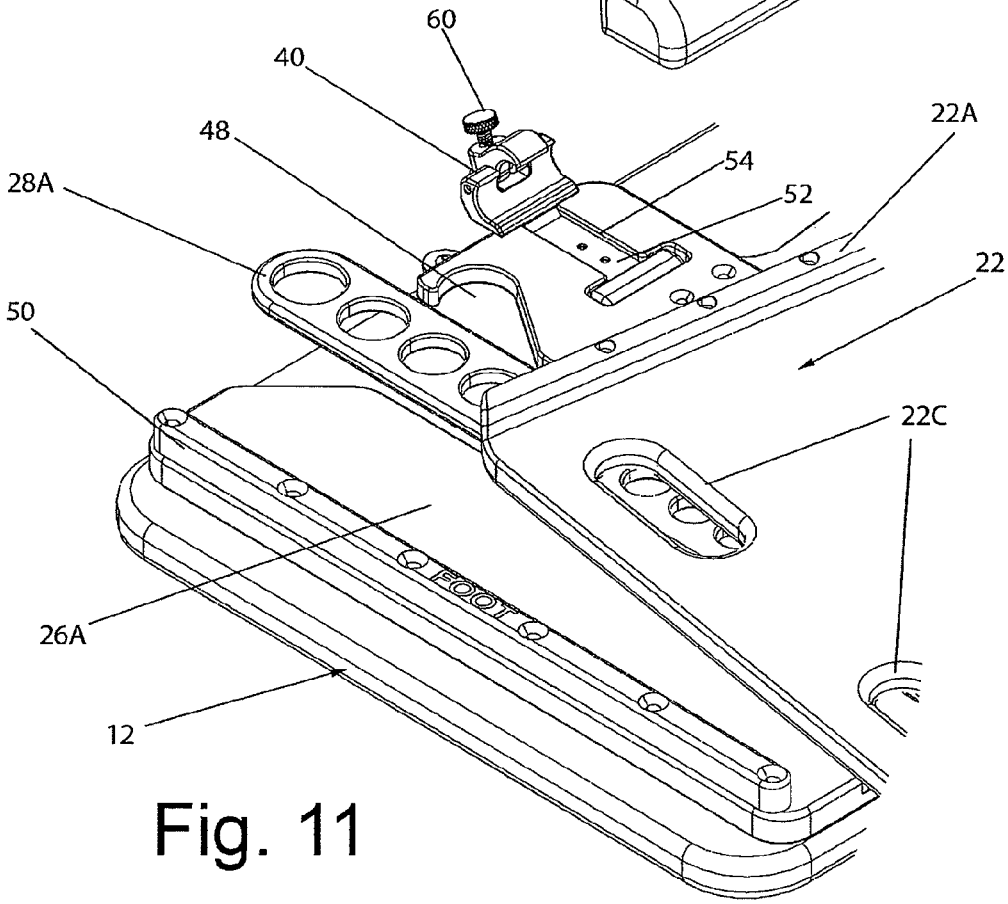
FIG. 11 is an enlarged isometric view of a portion of the system shown in FIG. 1 during the process of transferring the patient from the gurney to the treatment table.

Referring now to FIGS. 10 and 11, the details of an exemplary one of the various rail clamps 40 of the system 20 will now be described. As can be seen the clamp 40 basically comprises a body portion having a T-shaped base 52 which is arranged to be received within a correspondingly shaped slot 54 in the associated transfer plate. The slots in transfer plates 24A, 24C, 26A and 26C receive a correspondingly shaped base of a respective rail clamp 40 therein to releasably mount the clamp to the transfer plate. The remainder of the body portion of each clamp 40 is designated by the reference number 56 and projects upward from the T-shaped base to form a concave lower jaw portion of the clamp. Each clamp 40 also includes a movable upper jaw 58 which includes an arcuate concave surface located adjacent the arcuate concave surface forming the lower jaw. The arcuate surfaces of the upper and lower jaws conjoin to form the mouth portion 42 into which the portion of the peripheral edge of the longitudinally extending side rail 22A of the patient support panel 22 can be located. The upper jaw is arranged to be moved relative to the lower jaw by means of an adjustable thumbscrew 60 to close the socket/throat of the clamp and thereby releasably secure the patient support panel to the clamp.

After the patient has received his/her treatment he/she can be transferred back onto the gurney in a reciprocal manner than that described above for transferring the patient from the gurney to the treatment table. Thus, in the interest of brevity the procedure for transferring the patient back to the gurney will not be described herein.

As will be appreciated by those skilled in the art from the foregoing the system of the subject invention makes use of a support surface on which the patient is initially placed and the patient remains on that surface at all times, with the support surface being moved from a position fully in place on the gurney to a position fully in place on the treatment couch/table and vice versa. This is extremely important from the standpoints of safety, not disturbing the patient and reproducibility of patient positioning. Moreover, it should be appreciated that the subject invention is not limited for use with gurneys and treatment couches of radiation therapy machines, but can be used in any application wherein it is desired to transfer a patient from a movable support structure to a fixed or stationary support structure and/or vice versa. Further still, while each of the base units or modules 24 and 26 was shown and described as including three transfer plates, that arrangement is merely exemplary so that each module can have one, two, three or any number of transfer plates, if desired.

Without further elaboration the foregoing will so fully illustrate our invention that others may, by applying current or future knowledge, adopt the same for use under various conditions of service.

We claim:

1. A transfer system for transferring a patient from a first support structure to a second support structure, the first support structure being arranged to be moved to an operative position adjacent the second support structure, said transfer system comprising a patient support panel, a first base member and a second base member, said patient support panel being generally planar having a pair of ends and comprising a pair of longitudinally extending side rail portions, each of said side rail portions extending the length of the patient support panel between said pair of ends and projecting upward from the plane of said patient support panel, said first base member having a pair of ends comprising a first pair of clamps, one of said first pair of clamps being arranged to be mounted on the first support structure adjacent one end of said first base member, the other of said first pair of clamps being arranged to be mounted on the first support structure adjacent the other end of said first base member, said second base member comprising a second pair of clamps, one of said second pair of clamps being arranged to be mounted on the second support structure adjacent one end of said second base member, the other of said second pair of clamps being arranged to be mounted on the second support structure adjacent the other end of said second base member, said patient support panel being arranged to be disposed on the first support structure, said first and second base members having planar surfaces over which said patient support panel can be readily slid when the first support structure is in the operative position with respect to the second support structure, said first pair of clamps of said first base member being arranged to releasably secure said patient support panel on the first base member via said first pair of clamps of said first base member engaging one of said longitudinal extending side rail portions of said patient support panel adjacent said pair of ends of said patient support panel, said second pair of clamps of said second base member being arranged to releasably secure said patient support panel on said second base member via said second pair of clamps of said second base member engaging the other of said longitudinal extending side rail portions of said patient support panels adjacent said pair of ends of said patient support panel.

2. The system of claim 1 wherein said patient support panel includes handle portions for facilitating the transfer of said patient support panel from the first support structure to the second support structure.

3. The system of claim 1 wherein each of said base members includes a pair of slots in which respective ones of said first pair of clamps are located.

4. The system of claim 1 wherein each of the support structures and said patient support panel has a longitudinal axis and wherein said system includes a wrench that is arranged to cooperate with either of said base members to effect the orientation of said patient support panel so that said longitudinal axis of said patient support panel is generally aligned with the longitudinal axis of the support structure on which said patient support panel is disposed.

5. The system of claim 4 wherein said wrench comprises an elongated lever member having one end portion including a pair of rounded projections and an upstanding boss located adjacent said projections, and wherein each of said base members includes a complementary shaped recess for receiving one of said projections to enable said lever to be pivoted in said complementary shaped recess, whereupon said boss can engage a portion of said patient support panel to adjust its orientation.

6. A transfer system for transferring a patient from a first support structure to a second support structure, the first support structure being arranged to be moved to an operative position adjacent the second support structure, said transfer system comprising a patient support panel, a first base member, a second base member and at least one bridging member, said patient support panel comprising a pair of longitudinally extending side rail portions, said first base member comprising a first clamp and being arranged to be mounted on the first support structure, said second base member comprising a second clamp and being arranged to be mounted on the second support structure, said patient support panel being arranged to be disposed on the first support structure, said first and second base members having planar surfaces over which said patient support panel can be readily slid when the first support structure is in the operative position with respect to the second support structure, said first clamp of said first base member being arranged to releasably secure said patient support panel on the first base member via said first clamp of said first base member engaging one of said longitudinal extending side rail portions of said patient support panel, said second clamp of said second base member being arranged to releasably secure said patient support panel on said second base member via said second clamp of said second base member engaging the other of said longitudinal extending side rail portions of said patient support panels, said first base member comprising at least one first recess therein, said second base member comprising at least one second recess therein, said at least one bridging member being arranged to be located within said at least one first and second recess to bridge any space between the first and second support structures so that said patient support panel can readily slide from said first base member to said second base member via said at least one bridging member.

7. The system of claim 6 wherein said patient support panel includes handle portions for facilitating the transfer of said patient support panel from the first support structure to the second support structure.

8. The system of claim 6 wherein each of said base members includes a slot in which said clamp is located.

9. The system of claim 6 wherein each of the support structures and said patient support panel has a longitudinal axis and wherein said system includes a wrench that is arranged to cooperate with either of said base members to effect the orientation of said patient support panel so that said longitudinal axis of said patient support panel is generally aligned with the longitudinal axis of the support structure on which said patient support panel is disposed.

10. The system of claim 9 wherein said wrench comprises an elongated lever member having one end portion including a pair of rounded projections and an upstanding boss located adjacent said projections, and wherein each of said base members includes a complementary shaped recess for receiving one of said projections to enable said lever to be pivoted in said complementary shaped recess, whereupon said boss can engage a portion of said patient support panel to adjust its orientation.

11. The system of claim 10 wherein said patient support panel includes handle portions for facilitating the transfer of said patient support panel from the first support structure to the second support structure.

12. The system of claim 6 wherein said at least one bridging member includes a mid-portion formed of a low friction material.

13. The system of claim 6 wherein said at least one bridging member includes a stop member arranged to keep said first base member and said second base member a predetermined distance from each other.

14. The system of claim 13 wherein said at least one bridging member includes a mid-portion formed of a low friction material.

* * * * *